United States Patent [19]

Echtle

[11] 4,014,456

[45] Mar. 29, 1977

[54] INSULATED SANDWICH AND SALAD KEEPER

[76] Inventor: Mary Louise Echtle, Star Rte., Box 5, Castroville, Tex. 78009

[22] Filed: Oct. 31, 1975

[21] Appl. No.: 627,780

[52] U.S. Cl. ..... 220/306; 220/9 F; 220/13

[51] Int. Cl.² ..... B65D 43/10

[58] Field of Search ..... 220/9 F, 13, 306, 307, 220/354, 355; 62/438, 457; 150/.5

[56] References Cited

UNITED STATES PATENTS

| | | | |
|---|---|---|---|
| 2,711,840 | 6/1955 | Gits et al. | 220/306 |
| 2,767,711 | 10/1956 | Ernst | 220/306 X |
| 2,811,768 | 11/1957 | Axelson | 220/306 X |
| 3,149,747 | 9/1964 | Burgess | 220/306 |
| 3,484,015 | 12/1969 | Rowan | 220/306 X |
| 3,802,220 | 4/1974 | Pompo | 62/457 X |

FOREIGN PATENTS OR APPLICATIONS

| | | | |
|---|---|---|---|
| 814,231 | 6/1969 | Canada | 220/9 F |
| 1,351,951 | 11/1964 | France | 220/9 F |
| 1,107,745 | 1/1956 | France | 220/306 |
| 1,593,589 | 7/1970 | France | 220/9 F |
| 808,690 | 2/1959 | United Kingdom | 62/457 |

*Primary Examiner*—William Price
*Assistant Examiner*—Stephen Marcus

[57] ABSTRACT

An insulated keeper for maintaining sandwiches in a refrigerated condition with the keeper consisting of a hollow box shaped open topped receptacle having insulated wall and bottom surfaces and having a flat insulated cover adapted to snugly engage in an airtight manner the top edges of the side walls for sealing the container in an air tight manner to maintain a frozen sandwich placed therein at its cold temperature. In addition, an insulated salad keeper is provided having its walls made of STYROFOAM material. Still a further embodiment is in the form of a bowl having water containing compartments within double walls thereof for being pre-frozen prior to use thereof for retaining the contents of the bowl in a refrigerated condition.

2 Claims, 7 Drawing Figures

INSULATED SANDWICH AND SALAD KEEPER

BACKGROUND OF THE INVENTION

1. Field of the Invention

This invention relates generally to containers and more particularly to a novel insulated sandwich and salad keeper for the keeping of sandwiches, salads and the like in a cold refrigerated condition for a period of time.

2. Description of the Prior Art

While containers of various sizes, shapes and configurations are known in the prior art for a variety of purposes, including containers for the holding of sandwiches, none of these containers provides for the safekeeping of a frozen or refrigerated sandwich or salad for a period of time so that the contents may be consumed cold at a later time. For example, the packing of a frozen lunch sandwich or salad in the morning before an individual goes to work who desired to eat the same in a cold condition at lunch time, this being several hours after the keeper has been packaged.

SUMMARY OF THE INVENTION

The present invention provides a novel inflated sandwich and salad keeper for the holding of frozen or refrigerated sandwiches and salads in a cold condition for a lengthy period of time so that a sandwich or salad when cold and placed in the container will hold its coldness until it is desired to consume the same later.

It is a feature of the present invention to provide an insulated sandwich and salad keeper.

A further feature of the present invention provides an insulated sandwich and salad keeper which is relatively inexpensive to manufacture due to its simplicity of construction and availability of materials and manufacturing methods.

Still a further feature of the present invention provides an insulated sandwich and salad keeper which is easy to use and reliable and efficient in operation.

Yet still a further feature of the present invention provides an insulated sandwich and salad keeper which is aesthetically pleasing and refined in appearance and which is readily opened and closed without any special tools, skills or expertise or instructions required to the user.

Other features and advantages of this invention will be apparent during the course of the following description.

BRIEF DESCRIPION OF THE DRAWINGS

In the accompanying drawings forming a part of this specification, and in which like reference characters are employed to designate like parts througout the same:

DESCRIPTION OF THE PREFERRED EMBODIMENT

Figure 1:
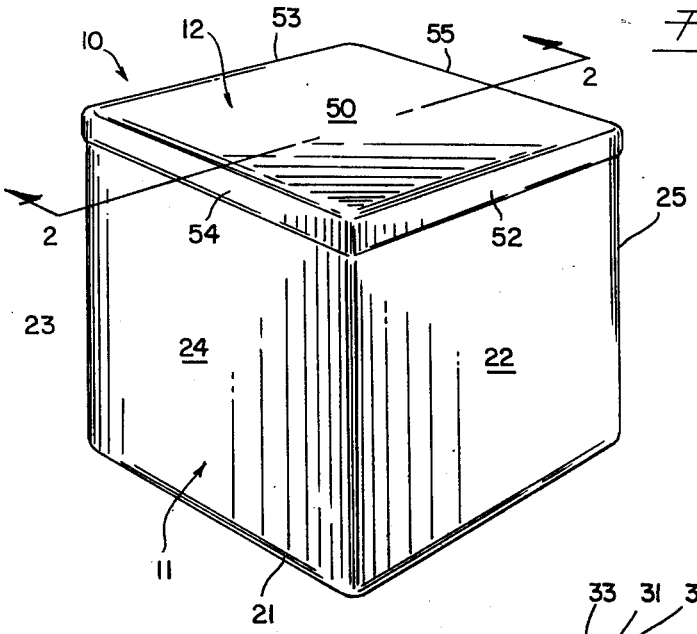
FIG. 1 is a top perspective view of the keeper of the present invention.
Figure 2:
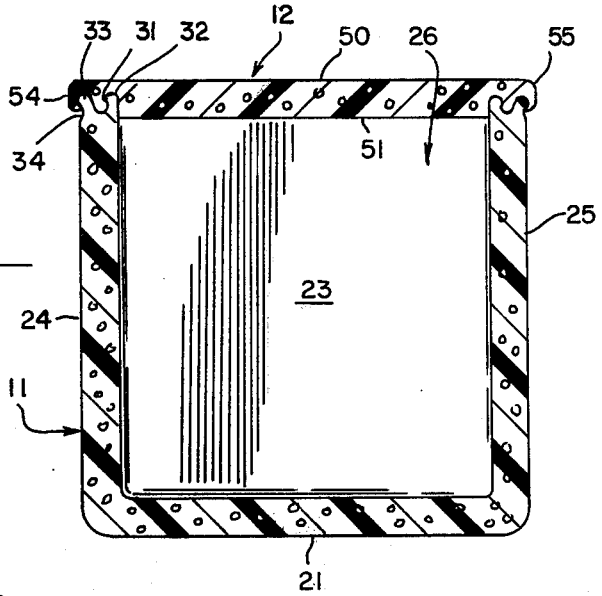
FIG. 2 is a cross-sectional view taken along line 2—2 of FIG. 1.
Figure 3:
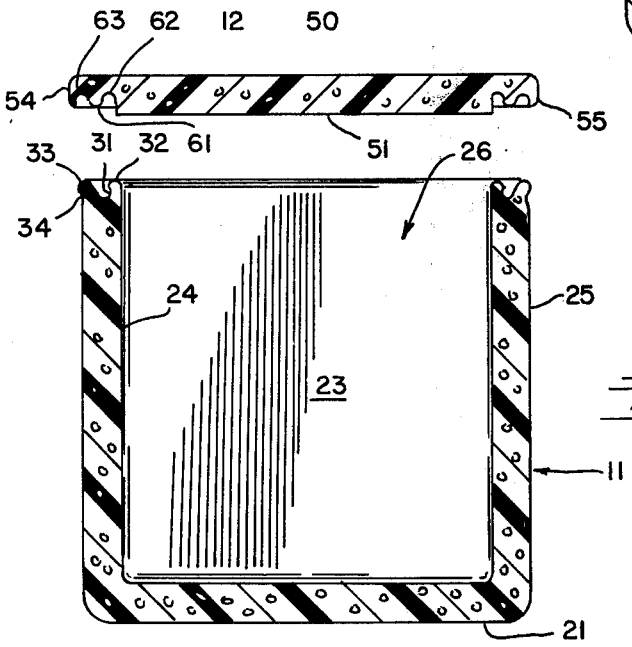
FIG. 3 is a cross-sectional view similar to FIG. 2 but with the cover illustrated separate from the receptacle.

Referring now to the drawings in detail and in particular to FIG. 1, 2 and 3 inclusive, there is illustrated a preferred form of an insulated sandwich and salad keeper constructed in accordance with the principles of the present invention and which is designated generally in its entirety by the reference numeral 10 and which is comprised of two component parts, namely, a box shaped receptacle 11 and a cover 12. Both the cover 12 and receptacle 11 are manufactured of STYROFOAM material having a high level of insulating qualities.

The receptacle 11 is of a hollow rectangular box shaped configuration having a horizontal flat bottom surface 21, vertically extending flat parallelly disposed front and back wall surfaces 22 and 23, and vertically disposed parallelly extending side wall surfaces 24 and 25. The surfaces 21–25 define interiorally thereof an open topped compartment 26 for receiving a sandwich (not shown) therein.

The top edges of the wall surfaces 22–25 are each provided with a groove 31 extending longitudinally therealong and having a semi-circular cross-sectional configuration so as to define at each side thereof a pair of longitudinally extending ribs 32 and 33. An annular recess 34 extends completely about the wall surfaces 22–25 at a position immediately beneath rib 33 as illustrated in the drawings.

The cover 12 is of a flat configuration having top surface 50, bottom surface 51, front and back edges 52 and 53, and opposed side edges 54 and 55. A pair of side-by-side grooves or notches 62 and 63 extend completely about the perimeter edge of bottom surface 51 and defined therebetween an angular rim 61, the notches 63 and 62 with rim 61 positioned so as to be oriented relative to rims 33 and 32 and groove 31 such that the cover 12 will fit onto the surrounding top edges of the receptacle 11 in an interlocking manner to seal the compartment 26 in an airtight manner.

There is thus provided a snap-on lid or cover 12 for the receptacle 11 for ease in placement onto and removal from the receptacle in a manner providing an air tight seal when in place on the receptacle for maintaining the sandwich disposed within compartment 26 in its cold condition.

Figure 4:
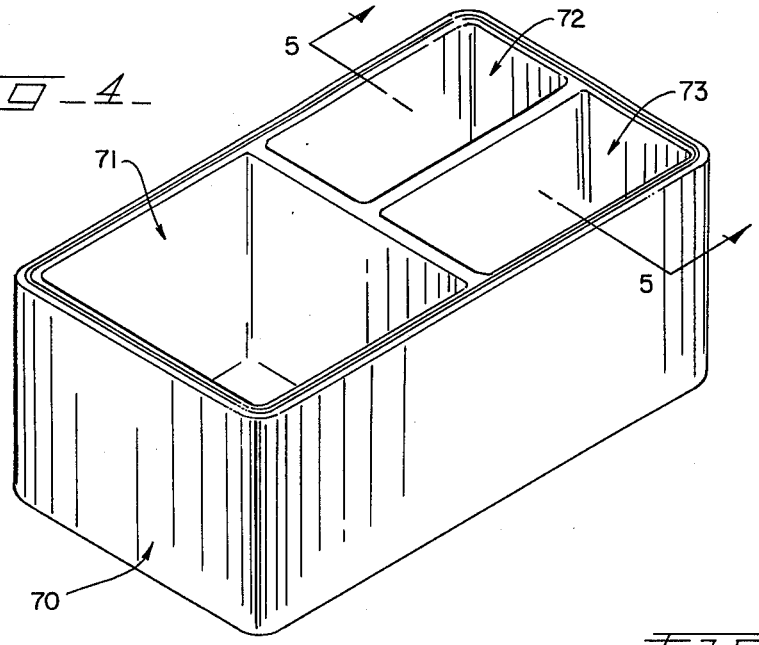
FIG. 4 is a perspective view of the insulated food keeper with interior compartments.
Figure 5:
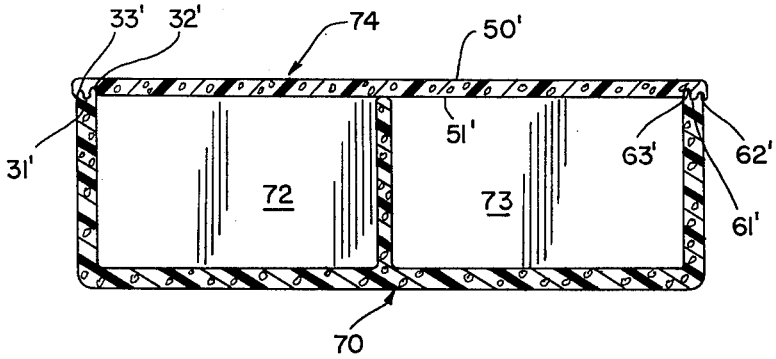
FIG. 5 is a cross-sectional view taken along line 5—5 of FIG. 4.

Referring now to the embodiments of FIGS. 4 and 5, there is illustrated a receptacle 70 of a hollow box-shaped configuration having interior compartments 71, 72 and 73 and which is provided with a flat cover member 74 for sealing the compartments in the same manner as cover member 12 to receptacle 11, and to avoid repetition of description, similar details between the embodiment of FIGS. 4 and 5 and that of FIG. 1–3 are indicated by similar reference numerals having a single prime mark applied thereto.

Figure 6:
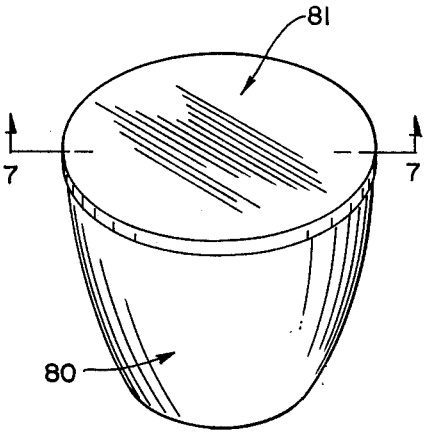
FIG. 6 is a perspective view of an insulated bowl.
Figure 7:
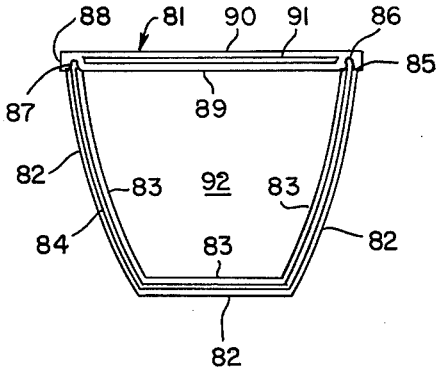
FIG. 7 is a cross-sectional view taken along line 7—7 of FIG. 6.

Referring now to the embodiment of FIGS. 6 and 7, there is illustrated a bowl member 80 having a cover 81, the bowl member being manufactured of a plastic material having outer wall 82 and spaced apart interior wall 83 which are maintained somewhat separated from each other to define water containing chamber 84 therein. The top edges 85 of the bowl 80 are provided with an annular rib 86 projecting outwardly therefrom to engage an annular notch 87 disposed about the circular perimeter 88 of the bottom surface 89 of cover 81 having top surface 90. Top surface 90 is maintained separated from bottom surface 89 to define a water containing chamber 91 therebetween. In operation, bowl 80 and cover 81 is placed in a freezer to freeze the water in chamber 84 and 91, after which the bowl is ready for use with contents being placed therein and the cover 90 being placed thereover to seal compartment 92 in an air tight manner and provide a frozen coldness of the frozen water to the contents to maintain the contents frozen for lengthy periods of time.

It is to be understood that the form of this invention as shown and described is to be taken as a preferred example of the invention, and that this invention is not to be limited to the exact arrangement of parts shown in the drawings or described in the description as various changes thereto pertaining to the details thereof as to size, shape and arrangement of parts thereto may be resorted to without departing from the scope of the novel concepts of the invention.

Having thus described the invention, what is claimed is:

1. An insulated salad and sandwich keeper comprising, in combination a hollow box shaped receptacle of a hollow rectangular box-shaped configuration having a horizontal flat bottom surface, a pair of opposed vertically extending parallel front and back wall surfaces, and a pair of vertically extending parallel side wall surfaces, the surfaces defining interiorly thereof a compartment open at its top to provide ingress and egress thereof;

a cover of said receptable consisting of a flat rectangularly shaped solid member having an exterior surface and interior surface, opposed flat front and back edges, and opposed flat side edges, the cover being of a width and length to completely overlap the open top of said receptacle compartment and engage the top edges of the wall surfaces in an air tight manner for sealing the receptacle compartment when the cover is in place thereon;

said receptacle and cover manufactured of insulating material;

said receptacle being characterized by a longitudinally extending groove of a semi-circular cross section disposed in the top edge of each of the wall surfaces of the receptacle, a pair of rib members formed on the top edges of wall members with each rib member being disposed on an opposite side of the groove and extending longitudinally therealong, an annular recess of a semi-circular configuration disposed completely about the exterior surfaces of the wall surfaces to define a plane parallel to the receptacle bottom surface and disposed immediately adjacent the bottom portion of one of the rib members, and with said cover member including a pair of parallelly extending grooves disposed in the interior surface completely about the edge surfaces and of a size and configuration to receive the receptacle ribs therein, a rib extending between the cover grooves and adapted to be received in the receptacle groove whereby the cover is snap-fitted to the receptacle for sealing the receptacle compartment.

2. An insulated salad and sandwich keeper as set forth in claim 1 wherein the receptacle and the cover are both manufactured of a STYROFOAM material.

* * * * *